United States Patent [19]

Crowley

[11] Patent Number: 4,881,329

[45] Date of Patent: Nov. 21, 1989

[54] ATHLETIC SHOE WITH ENERGY STORING SPRING

[75] Inventor: Kevin J. Crowley, Brentwood, N.H.

[73] Assignee: Wilson Sporting Goods Co., River Grove, Ill.

[21] Appl. No.: 244,035

[22] Filed: Sep. 14, 1988

[51] Int. Cl.[4] ..... A43B 21/30

[52] U.S. Cl. ..... 36/38; 36/27

[58] Field of Search ..... 37/7.8, 27, 38, 43, 37/76 C, 102, 114, 129; 106/97

[56] References Cited

U.S. PATENT DOCUMENTS

| | | | |
|---|---|---|---|
| 1,469,920 | 10/1923 | Dutchak | 36/38 |
| 1,471,966 | 10/1923 | Light | 36/38 |
| 1,638,350 | 8/1927 | Long | 36/7.8 |
| 1,942,312 | 1/1934 | Tutoky | 36/38 |
| 2,016,522 | 10/1935 | Stein | 36/43 |
| 2,413,545 | 12/1946 | Cordi | 36/7.8 |
| 4,342,158 | 8/1982 | McMahon et al. | 36/38 |
| 4,486,964 | 12/1984 | Rudy | 36/38 |
| 4,588,443 | 5/1986 | Bache | 106/97 |
| 4,638,575 | 1/1987 | Illustrato | 36/38 |
| 4,709,489 | 12/1987 | Welter | 36/27 |
| 4,774,774 | 10/1988 | Allen, Jr. | 36/28 |
| 4,798,009 | 1/1989 | Colonel | 36/28 |
| 4,815,221 | 3/1989 | Diaz | 36/27 |

*Primary Examiner*—Werner H. Schroeder
*Assistant Examiner*—Diana L. Biefeld

[57] ABSTRACT

An athletic shoe includes a spring in the midsole of the shoe. The spring is generally oval-shaped and includes convex top and bottom walls and a laterally extending opening. The spring is molded from high tensile material such as graphite fibers and resin, kevlar fibers and resin, glass fibers and resin, or ceramic materials.

15 Claims, 2 Drawing Sheets

FIG. 1
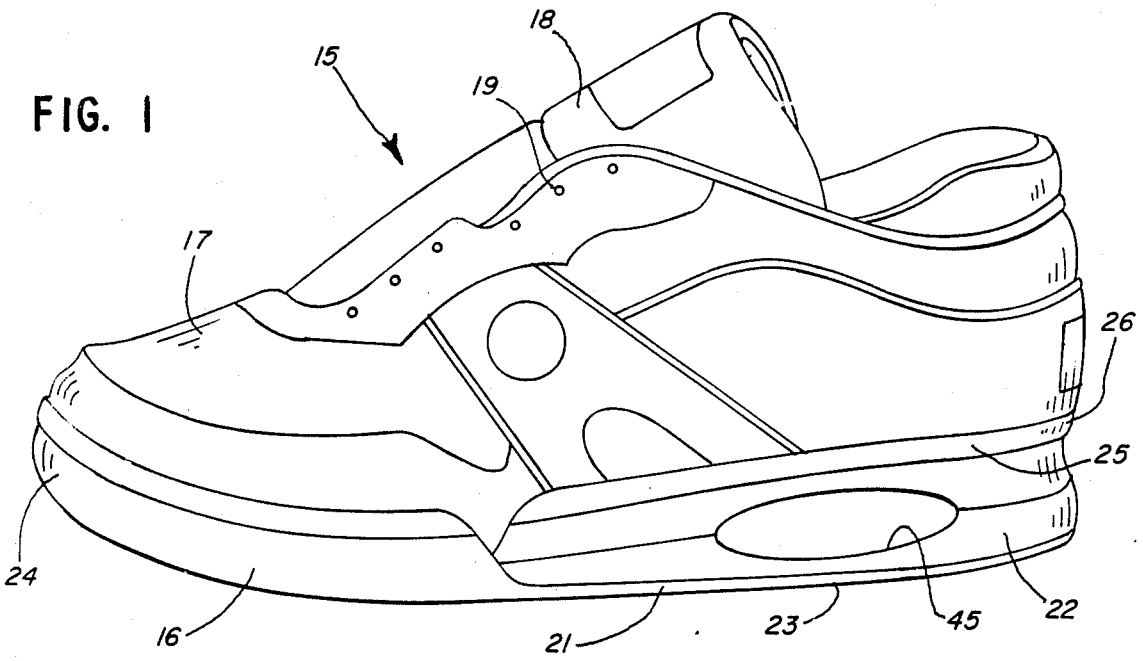
FIG. 2
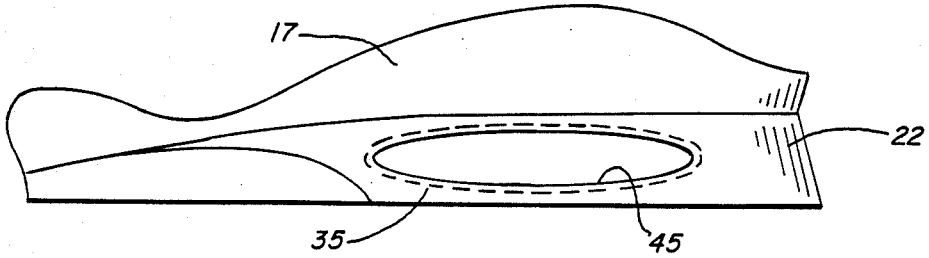
FIG. 3
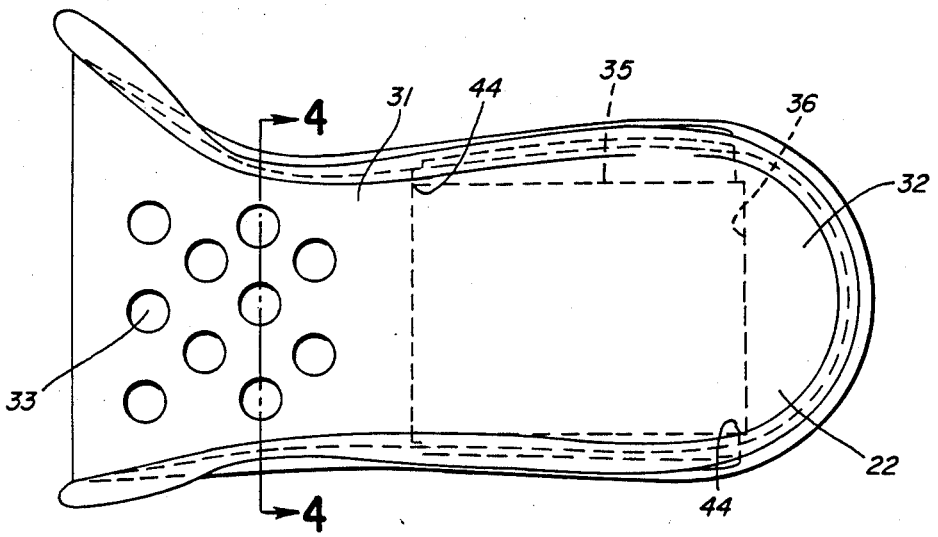
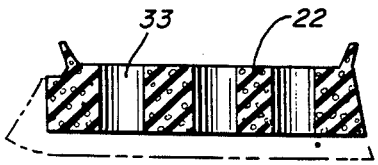
FIG. 4

FIG. 5
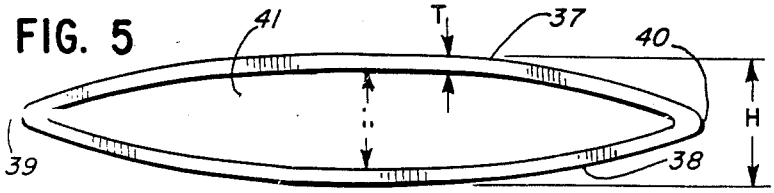
FIG. 10
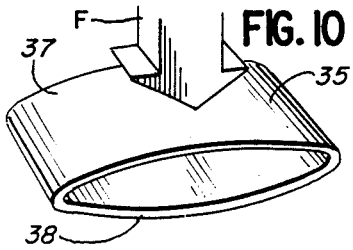
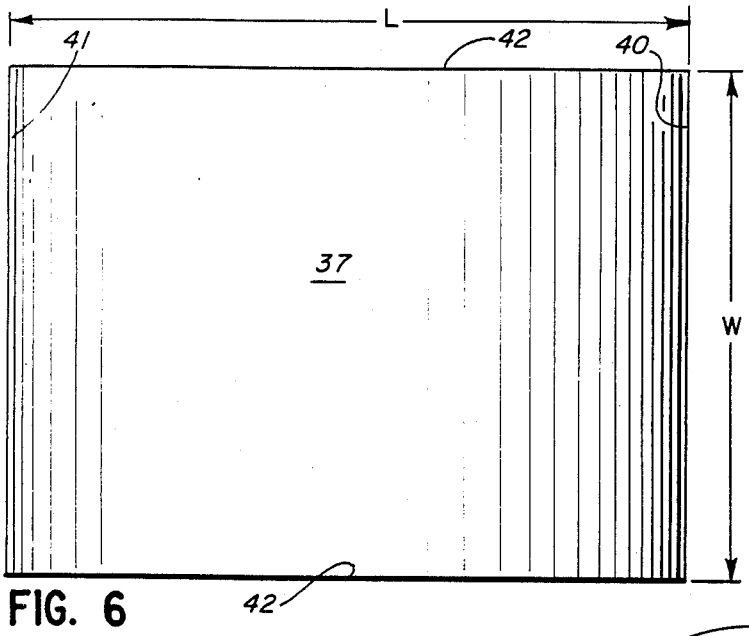
FIG. 6
FIG. 11
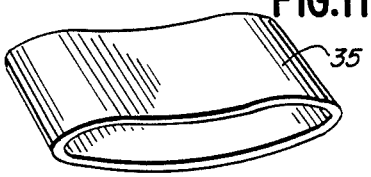
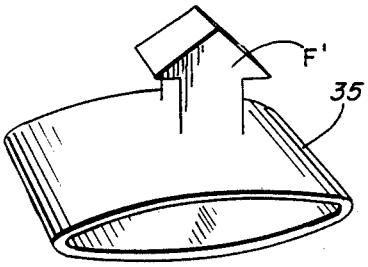
FIG. 12
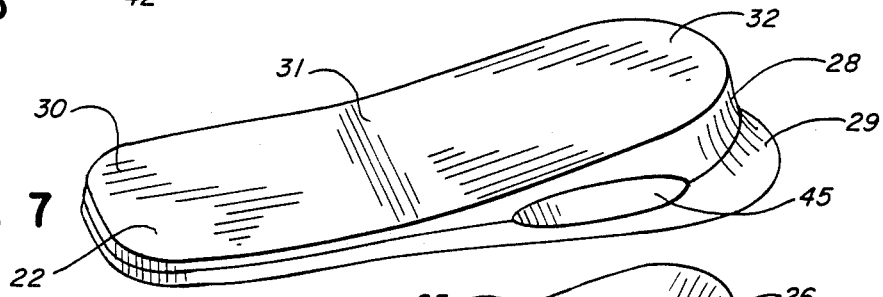
FIG. 7
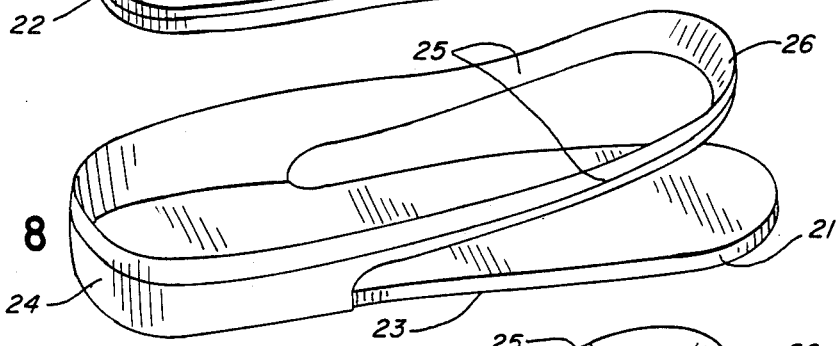
FIG. 8
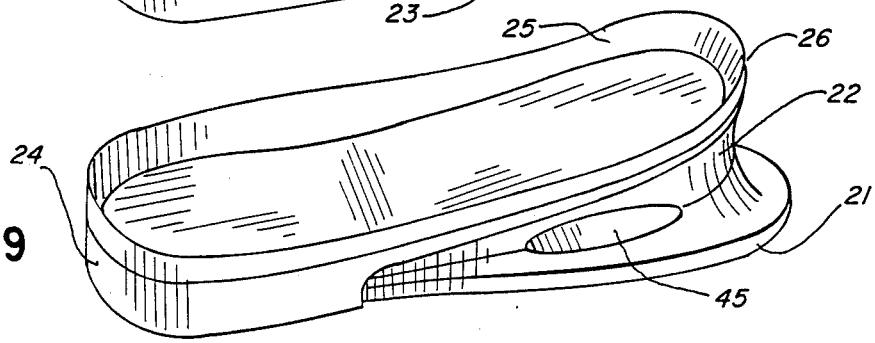
FIG. 9

ATHLETIC SHOE WITH ENERGY STORING SPRING

BACKGROUND

This invention relates to athletic shoes, and, more particularly, to an athletic shoe which includes a spring in the heel portion of the sole.

Various attempts have been made to provide athletic shoes with shock absorbing or energy storing devices such as resilient materials and springs. A shock absorbing material cushions the shock of the foot striking the ground. Some shock absorbing materials absorb energy and dissipate it as heat. The athlete therefore loses a portion of his kinetic energy every time his foot strikes the ground. An energy storing device stores energy as the foot strikes the ground and returns energy to the athlete as the foot leaves the ground.

The cushioning or energy storing device should be confined within the sole, but the height of the sole should be maintained within certain desired limits. In other words, the sole should not be excessively thick. The height or thickness constraint has limited the effectiveness of previous cushioning and energy striking materials.

The energy storing device should also be light weight. Some prior attempts to provide energy storing devices in shoes have resulted in shoes which were too heavy. For example, dress shoes and work shoes have been provided with steel springs, but steel springs are too heavy for athletic shoes such as tennis or basketball shoes.

SUMMARY OF THE INVENTION

The invention provides a lightweight yet durable spring for an athletic shoe which can deflect substantially to cushion the foot but which will store and return energy to the foot. The spring is generally oval-shaped and includes convex top and bottom walls which are joined at the front and back ends. A central opening extends laterally through the spring. The spring is molded from lightweight high tensile strength materials such as graphite fibers and resin, kevlar fibers and resin, glass fibers and resin, and ceramic materials. The high tensile strength materials provide a lightweight spring with a low profile which can be confined within the height of a normal sole while still providing advantageous deflection and energy storing.

DESCRIPTION OF THE DRAWING

The invention will be explained in conjunction with an illustrative embodiment shown in the accompanying drawing, in which FIG. 1 is a perspective view of an athletic shoe equipped with an energy storing spring in accordance with the invention;

FIG. 2 is a fragmentary side elevational view of the shoe;

FIG. 3 is a fragmentary top plan view of the sole of the shoe;

FIG. 4 is a sectional view taken along the line 4—4 of FIG. 3;

FIG. 5 is a side elevational view of the energy storing spring;

FIG. 6 is a top plan view of the spring;

FIG. 7 is a perspective view of the midsole of the shoe;

FIG. 8 is a perspective view of the outsole of the shoe;

FIG. 9 is a perspective view of the assembled outsole and midsole;

FIG. 10 is a perspective view of the spring showing a downward force being applied to the spring;

FIG. 11 is a perspective view of the spring in a deformed condition; and

FIG. 12 is a perspective view of the spring rebounding from the deformed condition.

DESCRIPTION OF SPECIFIC EMBODIMENT

Referring first to FIG. 1, an athletic shoe 15 includes a sole 16 and an upper 17. The upper includes the usual tongue 18 and eyelets 19 for a shoelace. The upper can be conventional and can be formed from leather, canvas, and/or synthetic material. The invention can be used in various types of athletic shoes, for example, tennis shoes, basketball shoes, running shoes, etc.

The particular sole 16 illustrated includes an outsole 21 and a midsole 22 (see also FIGS. 7–9). The outsole can be formed from conventional abrasion-resistant material such as rubber or other conventional materials. The midsole is molded from more resilient material such as polyurethane. An insole can be provided if desired.

The outsole 21 includes a bottom layer 23 which provides the bottom surface of the sole, a toe cap portion 24 which extends upwardly from the front end of the bottom layer, and side and rear portions 25 and 26 which are spaced from the bottom layer. If desired, however, the side and rear portions can extend upwardly from the bottom layer.

The midsole 22 includes upper and lower halves 28 and 29 which are joined together and which provide a toe portion 30, an arch or instep portion 31, and a heel portion 32. If desired, vertical bores or passages 33 (FIGS. 3 and 4) can be provided in the instep portion to reduce the weight of the sole.

A generally oval-shaped spring 35 (FIGS. 5 and 6) is positioned within a spring chamber 36 (FIG. 3) in the heel portion of the midsole before the upper and lower halves of the midsole are secured. The spring includes convexly curved top and bottom walls 37 and 38 which are joined along their front and rear ends 39 and 40. A central opening 41 extends laterally through the spring between the sides 42.

The height H of the spring is advantageously within the range of about 10 to 15 mm. so that it can be confined within a normal size midsole. The particular spring illustrated has a height H of 14 mm., a length L of 76 mm., and a width W of 56 mm. The thickness T of both the top and bottom walls is 1.5 mm. The maximum height h of the opening 41 is 11 mm. If desired, the bottom wall 38 can be thicker than the top wall 37 so that the top wall will deform more easily and the outsole will not be distorted.

Even though the spring has a low profile or height, the spring is provided with good hardness and energy-storing capability by molding the spring from high tensile strength composite material. The spring can be molded from graphite fibers and resin, kevlar fibers and resin, glass fibers and resin, or ceramic materials. The oval shape of the spring provides good deflection and resilience and minimizes the height.

Referring to FIG. 3, the spring chamber 36 in the midsole is provided with shoulders 44 which abut the sides of the spring and maintain the spring in the proper position. Lateral openings 45 (FIGS. 1, 2, and 7) extend from the spring chamber to the outside of the midsole. The surfaces of the midsole which contact the convex top and bottom walls of the spring can be shaped to mate with the curvature of the spring.

When a downward force F is applied by the foot to the heel portion of the midsole, the spring 35 is deformed as illustrated in FIGS. 10 and 11. The spring illustrated in FIGS. 10–12 has a top wall 37 which is thinner than the bottom wall 38, and the top wall therefore deforms more readily than the bottom wall. The deformed spring stores energy, and when the downward force is released, the spring rebounds to its original shape and returns the stored energy to the foot as indicated by the arrow F'.

The thickness of the top and bottom walls of the spring can be varied as desired to provide an optimum blend of cushioning and energy storing characteristics. A softer, more deformable spring will provide greater cushioning, and harder, more rigid spring will store and return more energy.

In the preferred embodiment of the spring both the top and bottom walls are convexly curved. However, if desired, one of the walls can be relatively flat.

In the particular embodiment illustrated, the sole is comprised of a separate outsole and a separate midsole, and the spring is positioned in the midsole. It will be understood, however, that the insole and outsole can form an integral sole.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. An athletic shoe comprising a sole having a heel portion, an instep portion and a toe portion; an upper attached to the sole; and a spring positioned in the heel portion of the sole; the spring being a one-piece, integrally formed member having top and bottom walls which are joined at the front and rear ends thereof and a center opening which extends laterally through the spring between the top and bottom walls, one of the walls being convexly curved.

2. The shoe of claim 1 in which both of the top and bottom walls of the spring are convexly curved.

3. The shoe of claim 1 in which the spring is made from molded graphite fibers and resin.

4. The shoe of claim 1 in which the spring is made from molded kevlar fibers and resin.

5. The shoe of claim 1 in which the spring is made from molded glass fibers and resin.

6. The shoe of claim 1 in which the spring is made from molded ceramic material.

7. The shoe of claim 1 in which the sole includes an outsole and a midsole above the outsole, the midsole having top and bottom surfaces and a spring chamber between the top and bottom surfaces, the spring being positioned within the spring chamber.

8. The shoe of claim 7 in which the midsole is molded from polyurethane.

9. The shoe of claim 7 in which the midsole has a heel portion, an instep portion, and a toe portion, the spring being positioned in the heel portion of the sole.

10. The shoe of claim 9 in which the midsole is provided with openings in each side thereof which communicate the spring chamber with the exterior of the midsole.

11. The shoe of claim 10 in which the midsole includes a pair of shoulders on each side of the spring chamber for retaining the spring in the spring chamber.

12. An athletic shoe comprising a sole, an upper attached to the sole, and a spring positioned in the sole, the spring having top and bottom walls which are joined at the front and rear ends thereof and a center opening which extends laterally through the spring between the top and bottom walls, said sole including an out-sole and a mid-sole above the out-sole, the midsole having top and bottom surfaces and a spring chamber between the top and bottom surfaces, the spring being positioned within the spring chamber, both walls of the spring being convexly curved and the bottom wall being thicker than the top wall.

13. The shoe of claim 12 in which the height of the spring is within the range of about 10 to 15 mm.

14. An athletic shoe comprising a sole, an upper attached to the sole, and a spring positioned in the sole, the spring having top and bottom walls which are joined at the front and rear ends thereof and a center opening which extends laterally through the spring between the top and bottom walls, both of the walls being convexly curved and the bottom wall of the spring being thicker than the top wall of the spring.

15. The shoe of claim 14 in which the height of the spring is within the range of about 10 to 15 mm.

* * * * *